US007266316B2

(12) United States Patent
Tanonaka

(10) Patent No.: US 7,266,316 B2
(45) Date of Patent: Sep. 4, 2007

(54) IMAGE FORMING APPARATUS

(75) Inventor: Atsushi Tanonaka, Osaka (JP)

(73) Assignee: Kyocera Mita Corporation (JP)

( * ) Notice: Subject to any disclaimer, the term of this patent is extended or adjusted under 35 U.S.C. 154(b) by 231 days.

(21) Appl. No.: 11/175,525

(22) Filed: Jul. 6, 2005

(65) Prior Publication Data

US 2007/0009271 A1 Jan. 11, 2007

(51) Int. Cl.
*G03G 15/20* (2006.01)

(52) U.S. Cl. ..... 399/45; 399/68

(58) Field of Classification Search ..... 399/45, 399/67, 68

See application file for complete search history.

(56) References Cited

U.S. PATENT DOCUMENTS 4,941,021 A * 7/1990 Uchida et al. ..... 399/45
5,260,751 A * 11/1993 Inomata ..... 399/68
6,118,514 A * 9/2000 Iwasaki

FOREIGN PATENT DOCUMENTS

JP 08169628 A * 7/1996
JP 2002311661 A * 10/2002
JP 2004-35177 2/2004

* cited by examiner

*Primary Examiner*—Susan Lee
(74) *Attorney, Agent, or Firm*—Gerald E. Hespos; Anthony J. Casella

(57) ABSTRACT

A machine (1) has a sheet size determiner (111) to determine the length of a recording sheet. A speed setter (112) sets the transport speed of a fixing roller in a transfer unit and the transport speed of a discharge roller at a discharge port. A fixing roller driver (1311) drives the fixing roller at the transport speed of the fixing roller, and a discharge roller driver (1312) drives the discharge roller at the transport speed of the discharge roller. The transport speed setter (112) sets the transport speed of the fixing roller higher than the transport speed of the discharge roller, and sets a difference between these speeds in relation to the length of the recording sheet determined by the sheet. This arrangement prevents a sheet jam and discharge of a recording sheet in an undulated state.

10 Claims, 4 Drawing Sheets

IMAGE FORMING APPARATUS

BACKGROUND OF THE INVENTION

1. Field of the Invention

The present invention relates to an image forming apparatus provided with at least two rollers arranged between a transfer unit for transferring a toner image onto a recording sheet, and a discharge port adapted for discharging the recording sheet transported from the transfer unit outside of the image forming apparatus.

2. Description of the Related Art

Generally, in image forming apparatuses such as a printer and a copier, an imaging unit with a photosensitive drum is widely used. In such an image forming apparatus, an electrostatic area is formed on the surface of the photosensitive drum by a charger, an electrostatic latent image is formed on the electrostatic area based on image data generated by laser light or the like irradiated from an exposure unit, and the electrostatic latent image is developed into a toner image by a developing unit. Then, the toner image is transferred onto a recording sheet by a transfer unit, followed by removal of toner residues from the surface of the photosensitive drum by a cleaning unit. After the transferred toner image is fixed onto the recording sheet by application of heat by a fixing roller provided in a fixing unit, the recording sheet carrying the fixed toner image is discharged outside of the image forming apparatus by a discharge roller.

In thermal fixation of the toner image, it is highly likely that moisture contained in the recording sheet may evaporate, thereby causing undulation of the recording sheet. In order to solve such a drawback, for instance, Japanese Unexamined Patent Publication No. 2004-35177 discloses a technique of flattening a recording sheet after an image fixation by setting the transport speed of the discharge roller higher than the transport speed of the fixing roller and applying a tension to the recording sheet.

Further, in recent years, there is known an image forming apparatus equipped with a so-called "short path mechanism", wherein the length of a transport path for transporting a recording sheet is shortened. In the image forming apparatus equipped with the short path mechanism, there is a case that merely a discharge roller is provided on the downstream side of the transport path relative to the fixing roller, and the transport path between the fixing roller and the discharge roller is curved.

If the arrangement disclosed in the publication is applied to the image forming apparatus equipped with the short path mechanism, it is highly likely that the recording surface of the recording sheet for image formation may be contacted with the inner wall of the curved transport path between the fixing roller and the discharge roller because the transport speed of the discharge roller is set higher than that of the fixing roller for the purpose of applying a tension to the recording sheet. The contact of the recording surface of the recording sheet with the inner wall of the curved transport path may likely cause adhesion of the fused toner that has just been fixed to the recording sheet to the inner wall of the transport path. As the image formation is repetitively carried out, the adhered toner may be accumulatively deposited, with the result that the deposited toner may clog the transport path, and resultantly cause a sheet jam.

There is an idea of relaxing a recording sheet while the recording sheet is being transported along the transport path between the fixing roller and the discharge roller by setting the transport speed of the discharge roller lower than the transport speed of the fixing roller. However, in the conventional art, the fixing roller and the discharge roller are constantly driven at the same speeds once the respective transport speeds thereof are determined. Therefore, in case of transporting a recording sheet of A3 size at the transport speed of transporting a recording sheet of A4 size, for instance, there is likelihood that the recording sheet of A3 size may be relaxed too much owing to a longer length of the A3 size recording sheet than the A4 size recording sheet, with the result that the recording sheet of A3 size may be undulated while being transported between the fixing roller and the discharge roller, and discharged in an undulated state.

SUMMARY OF THE INVENTION

In view of the problems residing in the prior art, it is an object of the present invention to provide an image forming apparatus that enables to prevent a sheet jam and to prevent discharge of a recording sheet in an undulated state.

An aspect of the invention is directed to an image forming apparatus comprising: at least a first roller and a second roller provided between a transfer unit for transferring a toner image onto a recording sheet, and a discharge port adapted for discharging the recording sheet transported from the transfer unit to an exterior of the image forming apparatus; a sheet length determiner which determines at least a length of the recording sheet; a transport speed setter which sets a transport speed of the first roller located on the side of the transfer unit, and a transport speed of the second roller located on the side of the discharge port; a first roller driver which drives the first roller at the transport speed of the first roller set by the transport speed setter; and a second roller driver which drives the second roller at the transport speed of the second roller set by the transport speed setter, wherein the transport speed setter sets the transport speed of the first roller higher than the transport speed of the second roller, and sets a difference between the transport speed of the first roller and the transport speed of the second roller in relation to the length of the recording sheet determined by the sheet length determiner.

According to this arrangement, at least the length of the recording sheet is determined, and the transport speed of the first roller located on the side of the transport unit, and the transport speed of the second roller located on the side of the discharge port are set. The transport speed of the first roller is set higher than the transport speed of the second roller, and a difference in transport speed between the first roller and the second roller is set in relation to the determined length of the recording sheet. The first roller is driven at the set transport speed of the first roller, and the second roller is driven at the set transport speed of the second roller.

With this arrangement, a sheet jam can be prevented by setting the transport speed of the first roller higher than the transport speed of the second roller in such a manner as to relax the recording sheet in the transport path between the first roller and the second roller. Further, discharge of the recording sheet in an undulated state can be prevented by setting the difference between the transport speed of the first roller and the transport speed of the second roller in relation to the length of the recording sheet.

These and other objects, features and advantages of the present invention will become more apparent upon reading of the following detailed description along with the accompanying drawings.

DETAILED DESCRIPTION OF THE PREFERRED EMBODIMENTS

Figure 1:
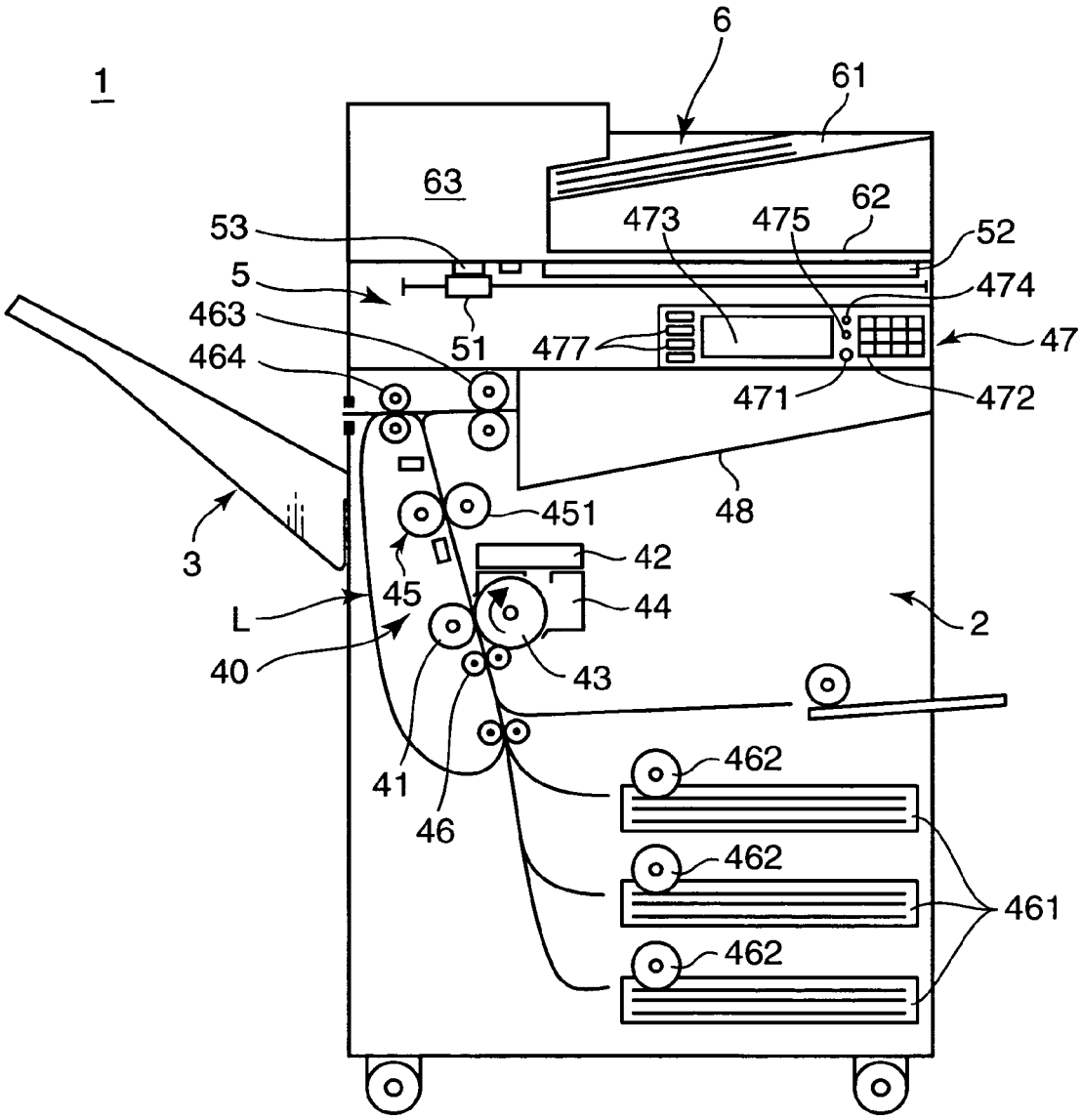
FIG. 1 is an elevational side view schematically showing an internal construction of an image forming apparatus embodying the invention.

In the following, a preferred embodiment of the invention is described referring to the accompanying drawings. FIG. 1 is an elevational side view schematically showing an internal construction of an image forming apparatus embodying the invention. The image forming apparatus is constructed as a complex machine 1 having multi-functions, such as functions of a copier, a printer, a fax, and a scanner. In the following, a construction and an operation of the complex machine 1 are described primarily focusing on a copier, as one of the functions of the complex machine 1.

The complex machine 1 has a machine body 2, a stack tray 3 arranged on the left side of the machine body 2 on the plane of FIG. 1, a document reading section 5 provided on an upper part of the machine body 2, and a document feeding section 6 provided on an upper part of the document reading section 5.

An operating section 47 is provided on a front part of the complex machine 1. The operating section 47 includes a start key 471 with which an operator is allowed to enter designation of executing image formation such as copying, ten keys 472 for entering the number of copies of the document for image formation or the like, a display unit 473 which displays operation guide information regarding various copying operations and the like, and which is comprised of a liquid crystal display or the like having a touch panel function for entering various settings in relation to the operation guide information, a reset key 474 for resetting the contents set on the display unit 473, a stop key 475 for suspending an ongoing image forming operation such as copying, and a function switchover key 477 for switching over the function of the complex machine 1 among the copying function, the printing function, the scanning function, and the faxing function.

The document reading section 5 includes a scanner unit 51 comprised of a charge coupled device (CCD) sensor, and an exposure lamp, a document table 52 made of a transparent material such as glass, and a document reader 53 in the form of a slit. The scanner unit 51 is movable by an unillustrated driving section. Specifically, in reading an image of a document placed on the document table 52, the scanner unit 51 travels along a plane of the document at a position opposite to the document table 52, and outputs image data acquired by the scanning to a main controller 100 (see FIG. 3), as scanning the document image. Further, in reading an image of a document fed by the document feeding section 6, the scanner unit 51 is moved to such a position as oppose to the document reader 53, and acquires image data representing the document image through the document reader 53, as timed with the feeding operation of the document by the document feeding section 6 for outputting the image data to the main controller 100.

The document feeding section 6 includes a document setting portion 61 for placing a document or documents thereon, a document discharging portion 62 for discharging the document(s) after image reading, and a document transport mechanism 63 including a feed roller (not shown), a transport roller (not shown), and the like for feeding the documents placed on the document setting portion 61 one after another to the position opposing to the document reader 53 to discharge the documents onto the document discharging portion 62. The document transport mechanism 63 further comprises a document switchback mechanism (not shown) for inverting the transport direction of the document to transport the document to the position opposing to the document reader 53 again, so that the images on both sides of the document are read by the scanner unit 51 through the document reader 53.

The document feeding section 6 is pivotally openable relative to the machine body 2, so that a forward portion of the document feeding section 6 can be lifted upward. By pivotally lifting the forward portion of the document feeding section 6 upward to open up the upper surface of the document table 52, an operator is allowed to place a document e.g. a book with its double page being spread onto the upper surface of the document table 52 for image reading.

The machine body 2 has sheet cassettes 461, a feed roller 462 for dispensing recording sheets stacked in each of the sheet cassettes 461 one by one to a recording section 40, and the recording section 40 for forming an image onto the recording sheet transported from the corresponding sheet cassette 461.

The recording section 40 includes an optical unit 42 for exposing a photosensitive drum 43 to laser light or the like by outputting the laser light or the like based on the image data acquired by the scanner unit 51, a developing unit 44 for forming a toner image on the surface of the photosensitive drum 43, a transfer unit 41 for transferring the toner image formed on the drum surface onto the recording sheet transported to the recording section 40, a fixing unit 45 for fixing the toner image onto the recording sheet by thermal fixation of the toner image transferred to the recording sheet, and discharge rollers 463, 464 which are arranged at their respective appropriate positions on a sheet transport path of the recording section 40 for transporting the recording sheet after the image fixation onto the stack tray 3 or onto a discharge tray 48. The fixing unit 45 has a fixing roller 451 for fixing the toner image onto the recording sheet by applying heat and a pressure to the recording sheet carrying the transferred toner image.

Further, in forming images on both sides of a recording sheet, after an image is formed on one of the both sides of the recording sheet by the recording section 40, the recording sheet is temporarily nipped in a nip portion between the discharge roller 463 and a counterpart driven roller, which are provided on the side of the discharge tray 48. Then, the transport direction of the recording sheet in the nipped state is switched back by reversing the rotating direction of the discharge roller 463 to thereby transport the recording sheet toward upstream of the recording section 40 along the sheet transport path L. Subsequently, after an image is formed on the other side of the recording sheet by the recording section 40, the recording sheet is discharged onto the stack tray 3 or onto the discharge tray 48.

It should be noted that although the discharge roller 463, the discharge roller 464, and the fixing roller 451 each constitutes a pair of rollers along with a counterpart driven roller, for sake of simplifying the explanation, the counterpart driven rollers of the discharge roller 463, the discharge roller 464, and the fixing roller 451 are not described unless otherwise needed.

Figure 2:
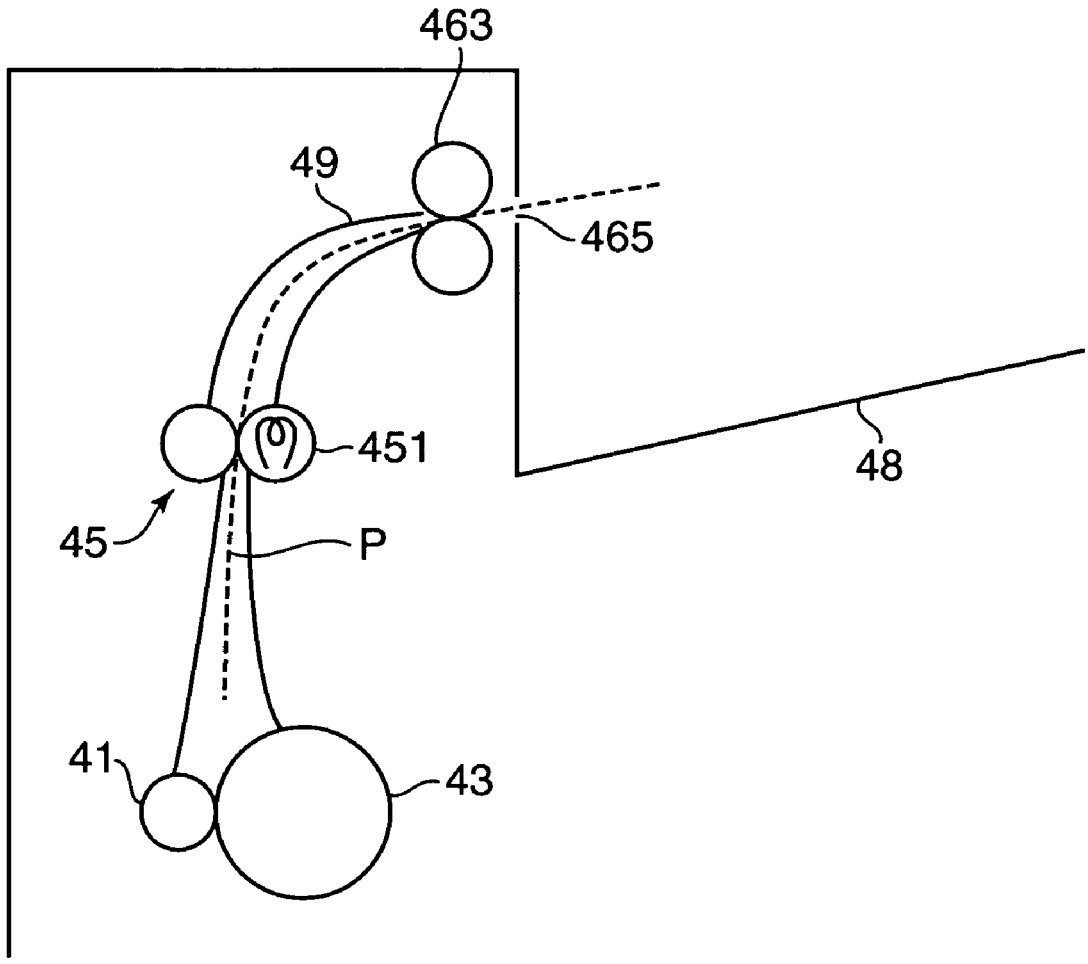
FIG. 2 is a cross-sectional view schematically showing a fixing roller, and a discharge roller, as well as their vicinities thereof in a complex machine as an example of the complex machine shown in FIG. 1.

FIG. 2 is a cross-sectional view schematically showing the fixing roller 451 and the discharge roller 463, as well as their vicinities in the complex machine 1 shown in FIG. 1. FIG. 2 shows a part of the transport path along which a recording sheet indicated by the broken line P is being transported by the fixing roller 451 and discharged onto the discharge tray 48 through a discharge port 465. As shown in FIG. 2, in the short path mechanism, a transport path 49 defined by the fixing roller 451 and the discharge roller 463 is curved toward the discharge tray 48, and there is no roller other than the fixing roller 451 and the discharge roller 463 in the transport path 49. After the toner image transferred from the surface of the photosensitive drum 43 is fixed onto the recording sheet P transported to the recording section 40 by application of heat and a pressure by the fixing roller 451, the recording sheet P is discharged onto the discharge tray 48 through the discharge port 465 by the discharge roller 463.

In this embodiment, control of the transport speed of the fixing roller 451 in the fixing unit 45, and the transport speed of the discharge roller 463 is described. Alternatively, the present invention is applicable to control of the transport speeds of two rollers provided between the transfer unit 41 or a transfer section for transferring a toner image onto a recording sheet P, and the discharge port 465 through which the recording sheet P transported from the transfer unit 41 is discharged outside of the machine body 2 onto the discharge tray 48.

Figure 3:
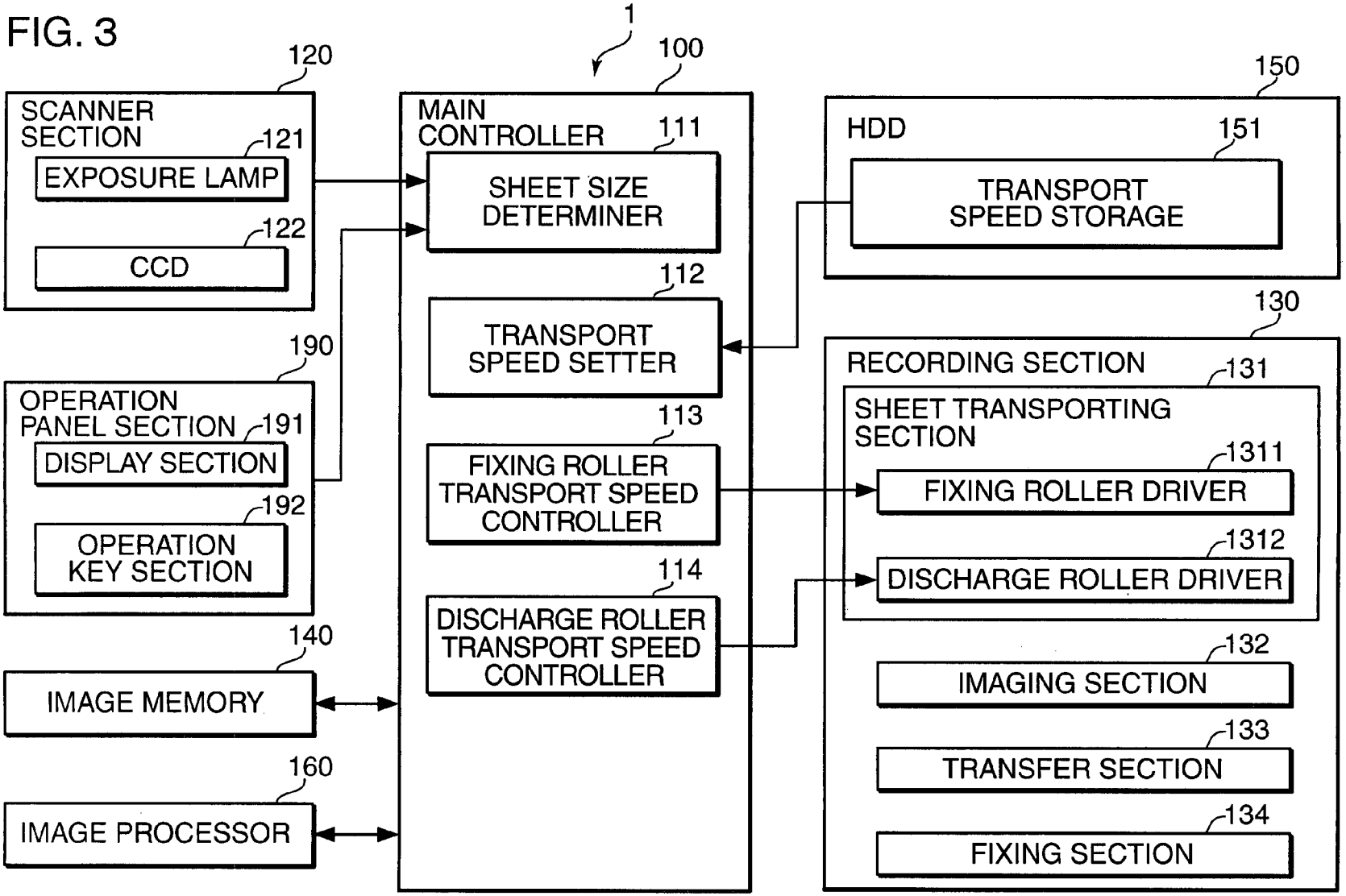
FIG. 3 is a functional block diagram showing a schematic arrangement of the complex machine.

FIG. 3 is a block diagram schematically showing the functions of the complex machine 1. The complex machine 1 has the main controller 100 which controls overall operations of the complex machine 1. The main controller 100 is connected with a scanner section 120 for reading a document image, and with a recording section 130 including a sheet transporting section 131, an imaging section 132, a transfer section 133, and a fixing section 134. The scanner section 120 includes an exposure lamp 121 and a CCD sensor 122. The main controller 100 is also connected with an image memory 140 for temporarily storing document data or the like read by the scanner unit 51, and with a hard disk drive (HDD) 150 serving as a storage and having a large capacity capable of storing a large amount of document data.

In reading a document image by the scanner section 120, an image processor 160 converts an analog image signal outputted from the scanner section 120 into a digital image signal, applies an image processing to improve the image quality, and converts the processed image into a compressed image. Throughout the specification and the claims, image data is also called as "an image" or "images" for the purpose of simplifying the description. The compressed image is written into the image memory 140. The main controller 100 stores the compressed image which has been written in the image memory 140 into the HDD 150 as file data for document administration. Further, in printing the registered document, the file data, namely, the compressed image to be printed is read out from the HDD 150 or from respective computers connected with the complex machine 1 via a network, and is written into the image memory 140. The image processor 160 decompresses the compressed file data, and applies an image processing conforming to the output status. For example, in case that image formation such as printing is performed by way of exposure to laser light, the decompressed file data is converted into a laser signal, which is a modulated analog signal, and the recording section 130, specifically, the imaging section 132 executes printing of the registered document based on the modulated analog laser signal.

An operation panel section 190 is adapted for an operator i.e. a user to enter various designations necessary for operating the complex machine 1. The operation panel section 190 is comprised of a liquid crystal display (LCD), and includes a display section 191 for displaying various operation messages necessary for operating the complex machine 1, and various information relating to the registered document(s), and an operation key section 192 including ten keys for entering designation of executing image formation such as copying or printing, the number of copies of the document for image formation such as copying or printing, and the like. Preferably, the display section 191 has a touch panel function, so that the operator can enter necessary designation by touching a relevant portion of the display section 191.

The operation panel section 190 accepts designation of the operator relating to an image forming operation such as copying, and sends a signal indicating the designation to the main controller 100. The operation panel section 190 receives a message or the like entered by the operator through the complex machine 1 from the main controller 100, and displays the contents of the message or the like. In this embodiment, entering of designation of the operator substantially corresponds to start of copying in response to pressing of the start key 471 by the operator. Upon receiving the message from the main controller 100, the operation panel section 190 sends a signal indicating start of copying to the main controller 100.

The scanner section 120 reads the image of the document placed on the document setting portion 61 in response to the message sent from the main controller 100, and stores the image of the document for copying into the image memory 140 as image data. The document feeding section 6 reads the size of the document in feeding the document, based on the position of a cursor (not shown) for use in detecting the width of the document, and on a detection result of a document length detecting sensor (not shown), and stores the information relating to the size of the document as part of the image data into the image memory 140. It should be noted that in the present specification, the width of an image corresponds to the size of a document in a direction orthogonal to the document feeding direction, and the length of an image corresponds to the size of the document in the document feeding direction. Further, the direction orthogonal to the document feeding direction coincides with a main scanning direction, and the document feeding direction coincides with a sub scanning direction. The complex machine 1 as the embodiment of the invention is capable of reading the sizes of documents whose width of an image is identical to each other, and whose length of an image is different from each other, and automatically selecting the size of a recording sheet coincident with the size of each document for copying. Upon completion of reading all the images of the documents placed on the document setting portion 61, the scanner section 120 notifies the main controller 100 of the number of the documents whose images have been read by the scanner section 120, and information that the documents have different sizes e.g. A3 size and A4 size, if the documents of the different sizes are to be copied.

The main controller 100 has an unillustrated central processing unit (CPU), and an unillustrated main storage such as a random access memory (RAM) for storing a program defining the operations of the CPU, and a read only memory (ROM) recorded with such a program. In other words, the main controller 100 has a computer. With this arrangement, the main controller 100 functions as a sheet size determiner 111, a transport speed setter 112, a fixing roller transport speed controller 113, and a discharge roller transport speed controller 114. The sheet transporting section 131 includes a fixing roller driver 1311, and a discharge roller driver 1312. The HDD 150 has a transport speed storage 151.

By causing the main controller 100 as the computer to read the program, the program is executed to realize the above functions. Alternatively, the program may be stored in a nonvolatile external storage of a large capacity such as the HDD 150, and run by the CPU by transferring the program to the main storage such as the RAM, according to needs. Further alternatively, it is possible to supply the program by way of a computer-readable recording medium such as an ROM or a CD-ROM or to supply the program by way of a transmission medium such as a network connected with a network interface (not shown). In case of supplying the program by way of an ROM, the program is run by the CPU by loading the ROM recorded with the program in the main controller 100.

The sheet size determiner 111 determines at least the length of the recording sheet P based on the size of the document read by the scanner section 120. The length of the recording sheet extends in a direction parallel with the transport direction of the recording sheet. Copy sheets of a predetermined format such as the size A (format A) or the size B (format B) have their lengths and widths set in advance. Therefore, the sheet size determiner 111 can determine the length of the recording sheet P by specifying the format of the recording sheet P, and by judging whether the longer side of the recording sheet P to be transported is perpendicular or parallel with the sheet transport direction.

In the embodiment, the sheet size determiner 111 determines the length of the recording sheet P based on the size of the document read by the scanner section 120 of the complex machine 1. Alternatively, the operation panel section 190 may determine the length of the recording sheet P based on the size of the recording sheet P designated through the operation panel section 190, if the operator has designated the size or the length of the recording sheet P by manipulation on the operation panel section 190. Further alternatively, in the case where the complex machine 1 functions as a printer, the length of the recording sheet may be determined based on the size or the length of the recording sheet designated by way of a terminal apparatus such as a personal computer connected to the printer.

The transport speed storage 151 stores in advance the transport speed of the fixing roller 451 and the transport speed of the discharge roller 463 in association with the length of the recording sheet P. The transport speed of the fixing roller 451 is set higher than the transport speed of the discharge roller 463. Further, the difference between the transport speed of the fixing roller 451 and the transport speed of the discharge roller 463 is set in relation to the length of the recording sheet P. Specifically, as the size or the length of the recording sheet P in the direction parallel with the sheet transport direction is increased, the speed difference is decreased.

For instance, let us assume that the recording sheet P has the A4 size, the recording sheet P is transported in a state that the longer side thereof extends in the direction parallel with the sheet transport direction, the transport speed of the fixing roller 451 is 230 mm/s, and the transport speed of the discharge roller 463 is 226 mm/s, then, the speed difference between the fixing roller 451 and the discharge roller 463 is 4 mm/s. On the other hand, if the recording sheet P has the A3 size, the recording sheet P is transported in a state that the longer side thereof extends in the direction parallel with the sheet transport direction, the transport speed of the fixing roller 451 is 230 mm/s, and the transport speed of the discharge roller 463 is 228 mm/s, then, the speed difference between the fixing roller 451 and the discharge roller 463 is 2 mm/s.

Preferably, the speed difference between the fixing roller 451 and the discharge roller 463 is set in such a manner that both the recording surface of the recording sheet P and the non-recording surface of the recording sheet P opposite to the recording surface are kept away from sliding contact with the inner wall of the transport path 49 between the fixing roller 451 and the discharge roller 463 while the recording sheet P is being transported along the transport path 49.

In the embodiment, the transport speed of the fixing roller 451 is set constant irrespective of the length of the recording sheet P, and the transport speed of the discharge roller 463 is set variable in association with the length of the recording sheet P. In this arrangement, setting of the transport speed of the fixing roller 451 is not required by changing the transport speed of the discharge roller 463 in relation to the length of the recording sheet while keeping the transport speed of the fixing roller 451 unchanged, and the transport speed of the fixing roller 451 can be set higher than the transport speed of the discharge roller 463 by merely setting the transport speed of the discharge roller 463.

The transport speed setter 112 reads out, from the transport speed storage 151, the transport speed of the fixing roller 451 and the transport speed of the discharge roller 463 corresponding to the length of the recording sheet P determined by the sheet size determiner 111 to set the readout transport speed of the fixing roller 451 and the readout transport speed of the discharge roller 463, and also sets the transport speed of the fixing roller 451 higher than the transport speed of the discharge roller 463, and sets the speed difference between the fixing roller 451 and the discharge roller 463 in association with the length of the recording sheet P determined by the sheet size determiner 111.

The fixing roller transport speed controller 113 outputs, to the fixing roller driver 1311, a drive signal for drivingly rotating the fixing roller 451 at the transport speed of the fixing roller 451 set by the transport speed setter 112. Likewise, the discharge roller transport speed controller 114 outputs, to the discharge roller driver 1312, a drive signal for drivingly rotating the discharge roller 463 at the transport speed of the discharge roller 463 set by the transport speed setter 112.

Alternatively, the discharge roller transport speed controller 114 may detect whether the recording sheet P has passed the nip portion of the fixing roller 451 to set the transport speed of the discharge roller 463 after the recording sheet P has passed the nip portion higher than the transport speed thereof before the recording sheet P passes the nip portion, based on a judgment result that the recording sheet P has passed the nip portion. In such an altered arrangement, since the transport speed of the discharge roller 463 after the recording sheet P has passed the nip portion of the fixing roller 451 is set higher than the transport speed thereof before the recording sheet P passes the nip portion, the speed of discharging the recording sheet P can be raised.

The fixing roller driver 1311 drivingly rotates the fixing roller 451 based on the drive signal outputted from the fixing roller transport speed controller 113 to transport the recording sheet P at the transport speed of the fixing roller 451 set by the transport speed setter 112. Likewise, the discharge roller driver 1312 drivingly rotates the discharge roller 463 based on the drive signal outputted from the discharge roller transport speed controller 114 to transport the recording sheet P at the transport speed of the discharge roller 463 set by the transport speed setter 112.

In this embodiment, the fixing roller 451 corresponds to an example of the first roller, the discharge roller 463 corresponds to an example of the second roller, the sheet size determiner 111 corresponds to an example of the sheet length determiner, the transport speed setter 112 corresponds to an example of the transport speed setter, the fixing roller transport speed controller 113 and the fixing roller driver 1311 correspond to an example of the first roller driver, and the discharge roller transport speed controller 114 and the discharge roller driver 1312 correspond to an example of the second roller driver.

Figure 4:
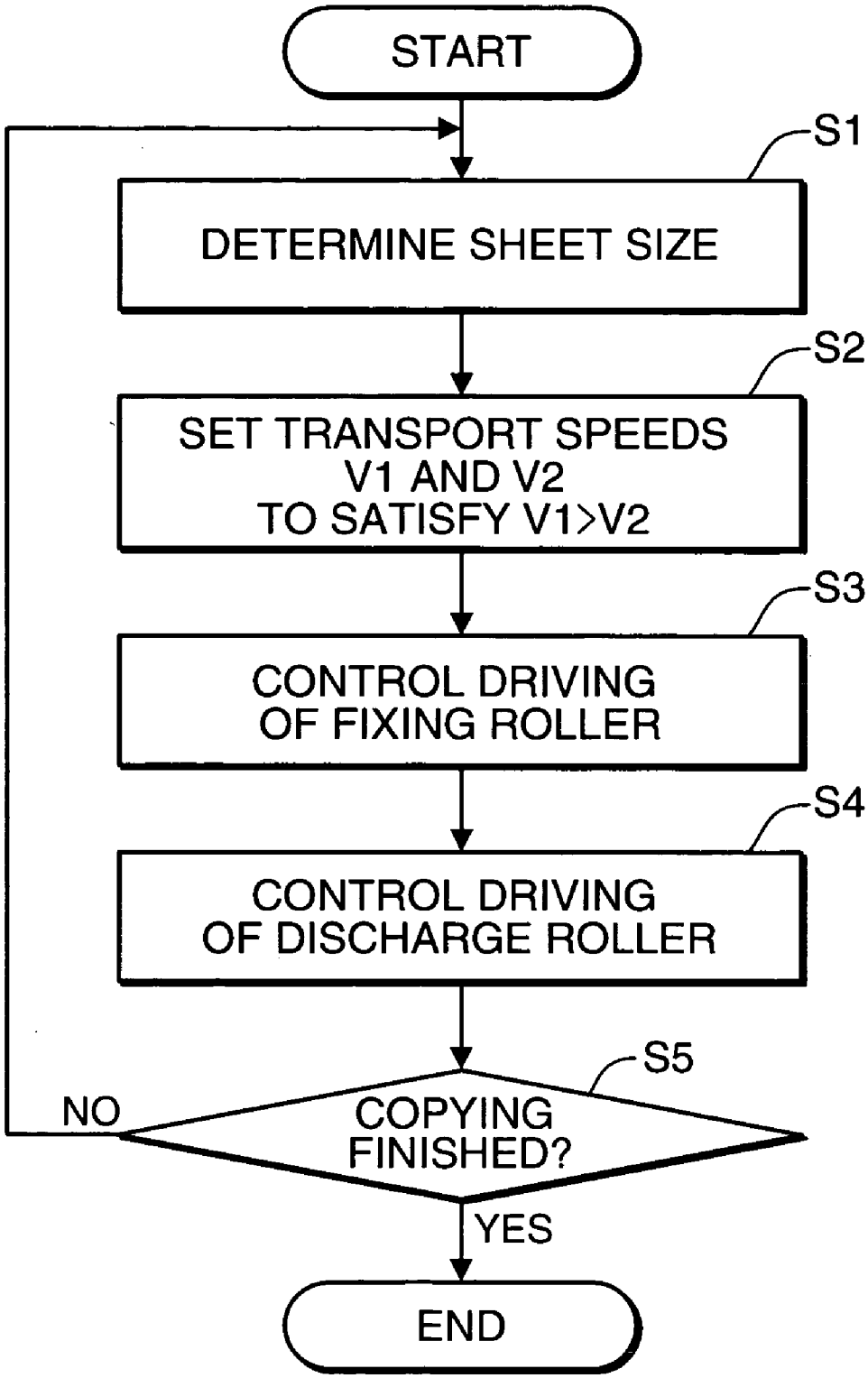
FIG. 4 is a flowchart for explaining an operation of the complex machine.

Next, an operation of the complex machine 1 embodying the invention is described referring to FIG. 4. FIG. 4 is a flowchart for explaining the operation of the complex machine 1.

First, in Step S1, the sheet size determiner 111 determines the length of the recording sheet P based on the size of the document for image formation.

Next, in Step S2, the transport speed setter 112 sets the transport speed V1 of the fixing roller 451 and the transport speed V2 of the discharge roller 463 based on the length of the recording sheet P determined by the sheet size determiner 111, so that the requirement: V1>V2 is satisfied. Specifically, the transport speed setter 112 reads out, from the transport speed storage 151, the transport speed V1 of the fixing roller 451 and the transport speed V2 of the discharge roller 463 corresponding to the length of the recording sheet P determined by the sheet size determiner 111 to set the readout transport speed V1 of the fixing roller 451 and the readout transport speed V2 of the discharge roller 463.

Subsequently, in Step S3, the fixing roller transport speed controller 113 outputs, to the fixing roller driver 1311, a drive signal for drivingly rotating the fixing roller 451 at the transport speed V1 of the fixing roller 451 set by the transport speed setter 112. Upon receiving the drive signal, the fixing roller driver 1311 drivingly rotates the fixing roller 451 based on the drive signal outputted from the fixing roller transport speed controller 113, so that the recording sheet P is transported to the discharge roller 463 at the transport speed V1 set by the transport speed setter 112.

In Step S4, the discharge roller transport speed controller 114 outputs, to the discharge roller driver 1312, a drive signal for drivingly rotating the discharge roller 463 at the transport speed V2 of the discharge roller 463 set by the transport speed setter 112. Upon receiving the drive signal, the discharge roller driver 1312 drivingly rotates the discharge roller 463 based on the drive signal outputted from the discharge roller transport speed controller 114, so that the recording sheet P is transported at the transport speed V2 set by the transport speed setter 112 onto the discharge tray 48 outside of the complex machine 1.

In Step S5, the main controller 100 judges whether all the recording sheets for image formation have been discharged, and the image formation has been finished. If it is judged that the image formation has been finished (YES in Step S5), the processing relating to the image formation is terminated because all the recording sheets have been discharged. On the other hand, if it is judged that the image formation has not been finished (NO in Step S5), the processing returns to Step S1 because not all the recording sheets have been discharged.

In this way, in the complex machine 1 as an example of the inventive image forming apparatus provided with at least two rollers between the fixing unit 45 for fixing a toner image onto a recording sheet P, and the discharge port 465 through which the recording sheet P is discharged outside of the complex machine 1, at least the length of the recording sheet P is determined, and the transport speed of the fixing roller 451 on the side of the fixing unit 45 and the transport speed of the discharge roller 463 on the side of the discharge port 465 are set. Further, the transport speed of the fixing roller 451 is set higher than the transport speed of the discharge roller 463, and the speed difference between the fixing roller 451 and the discharge roller 463 is set in relation to the determined length of the recording sheet P. The fixing roller 451 and the discharge roller 463 are driven at the respectively set transport speeds thereof.

In this arrangement, a sheet jam can be prevented by setting the transport speed of the fixing roller 451 higher than the transport speed of the discharge roller 463, so that the recording sheet P is relaxed to such an extent as to prevent a sheet jam while the recording sheet P is being transported along the transport path 49 between the fixing roller 451 and the discharge roller 463. In addition to this, discharge of a recording sheet P in an undulated state can be prevented by setting the speed difference between the fixing roller 451 and the discharge roller 463 in relation to the length of the recording sheet P.

Further, in the above arrangement, the speed difference between the fixing roller 451 and the discharge roller 463 is decreased, as the length of the recording sheet P determined by the sheet size determiner 111 in the direction parallel with the transport direction of the recording sheet P is increased. This arrangement enables to reduce flexure of the recording sheet P, which may likely to occur as the length of the recording sheet P in the direction parallel with the sheet transport direction is increased, thereby keeping the recording sheet P from being discharged in an undulated state.

Furthermore, in light of the arrangement that the transport path 49 between the fixing roller 451 and the discharge roller 463 is curved, the respective transport speeds of the fixing roller 451 and the discharge roller 463 are set in such a manner that the recording surface of the recording sheet P may be kept away from sliding contact with the inner wall of the transport path 49. Thus, since the respective transport speeds of the fixing roller 451 and the discharge roller 463 are controlled in such a manner as to keep the recording surface of the recording sheet P away from sliding contact with the inner wall of the curved transport path 49 between the fixing roller 451 and the discharge roller 463, there is no likelihood that the fused toner that has just been fixed to the recording sheet P may adhere to the inner wall of the transport path 49, and cause a sheet jam.

In the embodiment, thermal fixation of fixing a toner image onto a recording sheet P by the fixing roller 451 is employed. Alternatively, it is possible to apply flash fixation, wherein a toner image is fixed onto a recording sheet by allowing the toner to absorb heat of light energy generated by flashlight and instantaneously fusing the toner.

The image forming apparatus according to the embodiment of the invention has been described as a complex machine having functions of a printer, a copier, a fax, and a scanner. Alternatively, the invention is applicable to a copier, a printer, a fax, or an equivalent apparatus, as far as the apparatus has a function of image formation.

An image forming apparatus according to an aspect of the invention is directed to an image forming apparatus comprising: at least a first roller and a second roller provided between a transfer unit for transferring a toner image onto a recording sheet, and a discharge port adapted for discharging the recording sheet transported from the transfer unit to an exterior of the image forming apparatus; a sheet length determiner which determines at least a length of the recording sheet; a transport speed setter which sets a transport speed of the first roller located on the side of the transfer unit, and a transport speed of the second roller located on the side of the discharge port; a first roller driver which drives the first roller at the transport speed of the first roller set by the transport speed setter; and a second roller driver which drives the second roller at the transport speed of the second roller set by the transport speed setter, wherein the transport speed setter sets the transport speed of the first roller higher than the transport speed of the second roller, and sets a difference between the transport speed of the first roller and the transport speed of the second roller in relation to the length of the recording sheet determined by the sheet length determiner.

In the above arrangement, at least the length of the recording sheet is determined, and the transport speed of the first roller located on the side of the transfer unit, and the transport speed of the second roller located on the side of the discharge port are set. The transport speed of the first roller is set higher than the transport speed of the second roller, and the difference between the transport speed of the first roller and the transport speed of the second roller is set in relation to the determined length of the recording sheet. The first roller is driven at the set transport speed of the first roller, and the second roller is driven at the set transport speed of the second roller.

With the above arrangement, a sheet jam can be prevented by setting the transport speed of the first roller higher than the transport speed of the second roller to such an extent as to relax the recording sheet, while the recording sheet is being transported in a transport path between the first roller and the second roller. Further, discharge of a recording sheet in an undulated state can be prevented by setting the difference in transport speed between the first roller and the second roller in relation to the length of the recording sheet.

Preferably, the transport speed setter decreases the difference between the transport speed of the first roller and the transport speed of the second roller, as the length of the recording sheet determined by the sheet length determiner is increased. The length of the recording sheet extends in a direction parallel with a transport direction of the recording sheet.

In the above arrangement, the difference in transport speed between the first roller and the second roller is decreased, as the determined length of the recording sheet in the direction parallel with the transport direction of the recording sheet is increased. This arrangement enables to lessen flexure of the recording sheet, which is likely to occur as the length of the recording sheet in parallel with the transport direction of the recording sheet is increased, thereby keeping the recording sheet from being discharged in an undulated state.

Preferably, the transport speed setter keeps the transport speed of the first roller constant irrespective of the length of the recording sheet determined by the sheet length determiner, and sets the transport speed of the second roller in relation to the length of the recording sheet determined by the sheet length determiner.

In the above arrangement, the transport speed of the first roller is set constant irrespective of the length of the recording sheet determined by the sheet length determiner, and the transport speed of the second roller is set in relation to the length of the recording sheet determined by the sheet length determiner. With this arrangement, setting of the transport speed of the first roller is not necessary by changing the transport speed of the second roller in relation to the length of the recording sheet, while keeping the transport speed of the first roller unchanged, and the transport speed of the second roller can be set higher than the transport speed of the first roller by merely setting the transport speed of the second roller.

Preferably, the second roller driver drives the second roller, after the recording sheet has passed a nip portion of the first roller, at a transport speed higher than a transport speed of the second roller before the recording sheet passes the nip portion of the first roller.

In the above arrangement, since the transport speed of the second roller after the recording sheet has passed the nip portion of the first roller is set higher than the transport speed thereof before the recording sheet passes the nip portion, the speed of discharging the recording sheet can be raised.

Preferably, the image forming apparatus further comprises a transport speed storage which stores the transport speed of the first roller and the transport speed of the second roller in relation to the length of the recording sheet, wherein the transport speed setter reads out, from the transport speed storage, the transport speed of the first roller and the transport speed of the second roller in relation to the length of the recording sheet determined by the sheet length determiner to set the readout transport speed of the first roller and the readout transport speed of the second roller.

In the above arrangement, the transport speed of the first roller and the transport speed of the second roller are stored in advance in the transport speed storage in association with the length of the recording sheet. The transport speed of the first roller and the transport speed of the second roller are read out from the transport speed storage in association with the length of the recording sheet determined by the sheet length determiner to set the readout transport speed of the first roller and the readout transport speed of the second roller.

With the above arrangement, the respective transport speeds of the fist roller and the second roller can be set by reading out the respective transport speeds that have been stored in the transport speed storage in association with the length of the recording sheet, without calculating the respective transport speeds in association with the determined length of the recording sheet. Thereby, a processing time required for setting of the transport speeds can be shortened.

Preferably, the first roller includes a fixing roller which fixes the toner image onto the recording sheet, the second roller includes a discharge roller which discharges the recording sheet carrying the fixed toner image to the exterior of the image forming apparatus through the discharge port, a transport path defined by the fixing roller and the discharge roller is curved, and the transport speed setter sets the transport speed of the fixing roller and the transport speed of the discharge roller in such a manner as to keep a recording surface of the recording sheet away from sliding contact with the transport path.

In the above arrangement, the transport path is curved between the fixing roller for fixing the toner image onto the recording sheet, and the discharge roller for discharging the recording sheet carrying the fixed toner image outside of the image forming apparatus through the discharge port, and the respective transport speeds of the fixing roller and the discharge roller are set in such a manner as to keep the recording surface of the recording sheet away from sliding contact with the inner wall of the transport path. Since the respective transport speeds of the fixing roller and the discharge roller are set in such a manner as to keep the recording surface of the recording sheet away from sliding contact with the inner wall of the curved transport path between the fixing roller and the discharge roller, there is no likelihood that the fused toner that has just been fixed to the recording sheet may adhere to the inner wall of the transport path, and resultantly cause a sheet jam.

Preferably, the transport speed setter decreases a difference between the transport speed of the fixing roller and the transport speed of the discharge roller, as the length of the recording sheet determined by the sheet length determiner is increased. The length of the recording sheet extends in a direction parallel with a transport direction of the recording sheet.

In the above arrangement, the difference in transport speed between the fixing roller and the discharge roller is decreased, as the determined length of the recording sheet extending in the direction parallel with the transport direction of the recording sheet is increased. This arrangement enables to reduce flexure of the recording sheet, which may likely to occur as the length of the recording sheet in the direction parallel with the sheet transport direction is increased, thereby keeping the recording sheet from being discharged in an undulated state.

Preferably, the transport speed setter keeps the transport speed of the fixing roller constant irrespective of the length of the recording sheet determined by the sheet length determiner, and sets the transport speed of the discharge roller in relation to the length of the recording sheet determined by the sheet length determiner.

In the above arrangement, the transport speed of the fixing roller is kept constant irrespective of the length of the recording sheet determined by the sheet length determiner, and the transport speed of the discharge roller is set in association with the length of the recording sheet determined by the sheet length determiner. With this arrangement, setting of the transport speed of the fixing roller is not necessary by changing the transport speed of the discharge roller in relation to the length of the recording sheet while keeping the transport speed of the fixing roller unchanged, and the transport speed of the fixing roller can be set higher than the transport speed of the discharge roller by merely setting the transport speed of the discharge roller.

Preferably, the second roller driver drives the discharge roller, after the recording sheet has passed a nip portion of the fixing roller, at a transport speed higher than a transport speed of the discharge roller before the recording sheet passes the nip portion of the fixing roller.

In the above arrangement, since the transport speed of the discharge roller after the recording sheet has passed the nip portion of the fixing roller is set higher than the transport speed thereof before the recording sheet passes the nip portion, this arrangement enables to raise the speed of discharging the recording sheet.

Preferably, the image forming apparatus further comprises a transport speed storage which stores the transport speed of the fixing roller and the transport speed of the discharge roller in relation to the length of the recording sheet, wherein the transport speed setter reads out, from the transport speed storage, the transport speed of the fixing roller and the transport speed of the discharge roller in relation to the length of the recording sheet determined by the sheet length determiner to set the readout transport speed of the fixing roller and the readout transport speed of the discharge roller.

In the above arrangement, the transport speed of the fixing roller and the transport speed of the discharge roller are stored in advance in the transport speed storage in association with the length of the recording sheet. The transport speed of the fixing roller and the transport speed of the discharge roller are read out from the transport speed storage in association with the length of the recording sheet determined by the sheet length determiner to set the readout transport speed of the fixing roller and the readout transport speed of the discharge roller.

The above arrangement enables to set the respective transport speeds of the fixing roller and the discharge roller by reading out the respective transport speeds stored in association with the length of the recording sheet without calculating the respective transport speeds in association with the determined length of the recording sheet. Thereby, a processing time required for setting of the transport speeds can be shortened.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus comprising:

at least a first roller and a second roller provided between a transfer unit for transferring a toner image onto a recording sheet, and a discharge port adapted for discharging the recording sheet transported from the transfer unit to an exterior of the image forming apparatus;

a sheet length determiner which determines at least a length of the recording sheet;

a transport speed setter which sets a transport speed of the first roller located on the side of the transfer unit, and a transport speed of the second roller located on the side of the discharge port;

a first roller driver which drives the first roller at the transport speed of the first roller set by the transport speed setter; and a second roller driver which drives the second roller at the transport speed of the second roller set by the transport speed setter, the transport speed setter setting the transport speed of the first roller higher than the transport speed of the second roller, and setting a difference between the transport speed of the first roller and the transport speed of the second roller in relation to the length of the recording sheet determined by the sheet length determiner.

2. The image forming apparatus according to claim 1, wherein the transport speed setter decreases the difference between the transport speed of the first roller and the transport speed of the second roller, as the length of the recording sheet determined by the sheet length determiner is increased, the length of the recording sheet extending in a direction parallel with a transport direction of the recording sheet.

3. The image forming apparatus according to claim 1, wherein the transport speed setter keeps the transport speed of the first roller constant irrespective of the length of the recording sheet determined by the sheet length determiner, and sets the transport speed of the second roller in relation to the length of the recording sheet determined by the sheet length determiner.

4. The image forming apparatus according to claim 1, wherein the second roller driver drives the second roller, after the recording sheet has passed a nip portion of the first roller, at a transport speed higher than a transport speed of the second roller before the recording sheet passes the nip portion of the first roller.

5. The image forming apparatus according to claim 1, further comprising a transport speed storage which stores the transport speed of the first roller and the transport speed of the second roller in relation to the length of the recording sheet, wherein the transport speed setter reads out, from the transport speed storage, the transport speed of the first roller and the transport speed of the second roller in relation to the length of the recording sheet determined by the sheet length determiner to set the readout transport speed of the first roller and the readout transport speed of the second roller.

6. The image forming apparatus according to claim 1, wherein the first roller includes a fixing roller which fixes the toner image onto the recording sheet, the second roller includes a discharge roller which discharges the recording sheet carrying the fixed toner image to the exterior of the image forming apparatus through the discharge port, a transport path defined by the fixing roller and the discharge roller is curved, and the transport speed setter sets the transport speed of the fixing roller and the transport speed of the discharge roller in such a manner as to keep a recording surface of the recording sheet away from sliding contact with the transport path.

7. The image forming apparatus according to claim 6, wherein the transport speed setter decreases a difference between the transport speed of the fixing roller and the transport speed of the discharge roller, as the length of the recording sheet determined by the sheet length determiner is increased, the length of the recording sheet extending in a direction parallel with a transport direction of the recording sheet.

8. The image forming apparatus according to claim 6, wherein the transport speed setter keeps the transport speed of the fixing roller constant irrespective of the length of the recording sheet determined by the sheet length determiner, and sets the transport speed of the discharge roller in relation to the length of the recording sheet determined by the sheet length determiner.

9. The image forming apparatus according to claim 6, wherein the second roller driver drives the discharge roller, after the recording sheet has passed a nip portion of the fixing roller, at a transport speed higher than a transport speed of the discharge roller before the recording sheet passes the nip portion of the fixing roller.

10. The image forming apparatus according to claim 6, further comprising a transport speed storage which stores the transport speed of the fixing roller and the transport speed of the discharge roller in relation to the length of the recording sheet, wherein the transport speed setter reads out, from the transport speed storage, the transport speed of the fixing roller and the transport speed of the discharge roller in relation to the length of the recording sheet determined by the sheet length determiner to set the readout transport speed of the fixing roller and the readout transport speed of the discharge roller.

* * * * *